US005973304A

United States Patent [19]

Kim

[11] Patent Number: 5,973,304

[45] Date of Patent: Oct. 26, 1999

[54] MICROWAVE OVEN HAVING A SILENT COOKING MODE AND METHOD FOR OPERATING THE MICROWAVE OVEN

[75] Inventor: You-Ho Kim, Incheon, Rep. of Korea

[73] Assignee: Daewoo Electronics Co., Ltd., Seoul, Rep. of Korea

[21] Appl. No.: 09/138,366

[22] Filed: Aug. 21, 1998

[30] Foreign Application Priority Data

Nov. 21, 1997 [KR] Rep. of Korea ..... 97-61745

[51] Int. Cl.[6] ..... H05B 6/68

[52] U.S. Cl. ..... 219/702; 219/715; 219/718; 219/719; 219/757; 99/325

[58] Field of Search ..... 219/702, 715, 219/716, 718, 719, 721, 757; 99/325

[56] References Cited

U.S. PATENT DOCUMENTS 4,777,575 10/1988 Yamato et al. ..... 363/21
5,200,589 4/1993 Kim ..... 219/707
5,350,903 9/1994 Takei ..... 219/716
5,498,858 3/1996 Jeong ..... 219/757

*Primary Examiner*—Philip H. Leung
*Attorney, Agent, or Firm*—Pillsbury Madison & Sutro LLP

[57] ABSTRACT

A microwave oven having a silent cooking mode and a method for operating the microwave oven are disclosed. The microwave oven has a magnetron driving section connected to a secondary winding of a high voltage transformer which receives an external power source via a primary winding thereof. A fan motor ventilates a cooking chamber of the microwave oven and a silent cooking mode selecting key selects the silent cooking mode. Voltage dividing section divides the voltage of the external power source. Switching section supplies the external power source to the fan motor at a normal cooking mode and supplies the external power source of which the voltage is divided by the voltage dividing section to the fan motor at the silent cooking mode. Control section controls the switching section in response to a key signal from the silent cooking mode selecting key. Accordingly, when the user selects the silent cooking mode, a noise generated from the fan motor is reduced remarkably. As a result, the user can comfortably cook food at night.

10 Claims, 3 Drawing Sheets

MICROWAVE OVEN HAVING A SILENT COOKING MODE AND METHOD FOR OPERATING THE MICROWAVE OVEN

BACKGROUND OF THE INVENTION

1. Field of the Invention

The present invention relates to a microwave oven having a silent cooking mode which can reduce noise generated when a user warms up food at night by adding the silent cooking mode to the microwave oven and a method for operating the microwave oven.

2. Description of the Prior Art

In general, a microwave oven warms up food by using microwaves.

When a door is either opened or shut by a user, a micro-switch of the microwave oven is operated according to the opening and shutting of the door. When the microswitch is operated, a magnetron generates the microwaves in response to a high voltage generated from a high voltage transformer. At this time, the heat generated from the magnetron of the microwave oven is cooled down by means of an external air inhaled from a fan motor of the microwave oven.

As described above, a cooking operation of the microwave oven is controlled by control apparatus installed in the microwave oven.

FIG. 1 is a block diagram for showing a circuit configuration of an apparatus for controlling a conventional microwave oven.

Referring to FIG. 1, the control apparatus of the microwave oven has a plug 10, a fuse 11, a temperature switch 12, a first switch 13, a control assembly 14, a second switch 17, contacts 15 and 16, a high voltage transformer 22, a high voltage rectifying section 23, a magnetron 24, a cooking chamber lamp 19, a tray motor 20, a fan motor 21, and a third switch 18. Control assembly 14 has a transformer 14*a*, and first and second relays 14*b* and 14*c*. High voltage rectifying section 23 has a high voltage diode 23*a* and a high voltage capacitor 23*b*.

When the user closes the door for cooking the food, first switch 13 and third switch 18 are turned on and second switch 17 is turned off.

Accordingly, a common alternating current source from plug 10 is applied to transformer 14*a* of control assembly 14 via fuse 11 and temperature switch 12. The common alternating current source of which the voltage is dropped to a predetermined voltage level by transformer 14*a* is applied to first relay 14*b*, second relay 14*c*, and a control section (not shown) as an operating current source, respectively.

At this time, when the user inputs a cooking start signal for cooking the food via a key input section (not shown), the control section excites first and second relays 14*b* and 14*c* in order to turn on the respective contacts 15 and 16 of first and second relays 14*b* and 14*c*.

Accordingly, the common alternating current source to which is applied via fuse 11 is applied to a primary winding of high voltage transformer 22 via first switch 13 and contact 15 of first relay 14*b* and is applied to cooking chamber lamp 19, tray motor 20, and fan motor via contact 16 of second relay 14*c*, respectively.

High voltage transformer 22 boosts a voltage of the common alternating current source applied via contact 15 of first relay 14*b* and plug 10. The boosted common alternating current source is converted into a direct current source by high voltage diode 23*a* and high voltage capacitor 23*b* of high voltage rectifying section 23 and is applied to magnetron 24.

Magnetron 24 generates the microwaves in response to the common alternating current source applied from high voltage rectifying section 23 and the food of the cooking chamber is cooked by the microwaves.

Meanwhile, cooking chamber lamp 19 emits light to the inside of the cooking chamber in response to the common alternating current source applied via contact 16 of second relay 14*c* and plug 10. Also, tray motor 20 rotates the tray on which the food is placed in response to the common alternating current source applied via contact 16 of second relay 14*c* and plug 10. Accordingly, the food which is put on the tray of the cooking chamber is uniformly cooked.

In addition, fan motor 21 is operated by the common alternating current source applied via contact 16 of second relay 14*c* and plug 10. Fan motor 21 inhales the external air for cooling the heat generated from high voltage transformer 22, magnetron 24, and the cooking chamber.

When the food put on the tray is cooked, the control section (not shown) turns off first and second relays 14*b* and 14*c* of control assembly 14. Accordingly, high voltage transformer 22, cooking chamber lamp 19, fan motor 21, and tray motor 20 are turned off.

Meanwhile, when the user opens the door while the food is cooked, the driving of magnetron 24 and of fan motor 21 is stopped by the opening of first switch 13 and of third switch 18. At this time, when first switch 13 is malfunctioned, the common alternating current source from plug 10 is not broken though the door is opened. However, in this case, since second switch 17 is turned on, the common alternating current source is broken.

As described above, in the prior microwave oven, when the food is cooked, cooking chamber lamp 19, tray motor 20, and fan motor 21 are simultaneously controlled by second relay 14*b* of control assembly 14.

Accordingly, when the microwave oven is operated, it is difficult to control an oscillating sound from magnetron 24 and a noise from fan motor 21. Particularly, in the night, since the noise from the fan motor 21 is loud, it's very difficult for the user to use the microwave oven.

SUMMARY OF THE INVENTION

Therefore, it is an object of the present invention to provide a microwave oven having a silent cooking mode which can control a rotation speed of a fan motor by dividing a voltage of a common alternating current source applied to the fan motor when the microwave oven is operated.

It is another object of the present invention to provide a method for operating a microwave oven having a silent cooking mode in order to reduce a noise generated from a fan motor when the microwave oven is operated.

In order to achieve the above objects, a microwave oven having a silent cooking mode, wherein the microwave oven has a magnetron driving means connected to a secondary winding of a high voltage transformer which receives an external power source via a primary winding thereof, which comprises:

- a fan motor for ventilating a cooking chamber of the microwave oven;
- a silent cooking mode selecting key for selecting the silent cooking mode;
- voltage dividing means for dividing a voltage of the external power source;

switching means for supplying the external power source to the fan motor at a normal cooking mode and for supplying the external power source of which the voltage is divided by the voltage dividing means to the fan motor at the silent cooking mode; and control means for controlling the switching means in response to a key signal from the silent cooking mode selecting key.

In order to achieve the above objects, a method for operating a microwave oven having a silent cooking mode, which comprises the steps of:

(i) checking whether or not a silent cooking mode is selected;

(ii) executing a normal cooking mode by supplying an external power source to a fan motor when it is checked in step (i) that the silent cooking mode is not selected; and (iii) executing the silent cooking mode by supplying the external power source of which the voltage is divided when it is checked in step (i) that the silent cooking mode is selected.

In the microwave oven having a silent cooking mode and method for operating the microwave oven according to the present invention, a rotation speed of the fan motor of the microwave oven is variably set according to the selection of a user. Accordingly, when the user selects the silent cooking mode, a noise generated from the fan motor is reduced remarkably. As a result, the user can comfortably cook the food at night.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail with reference to the accompanying drawings to a configuration and an operation of a microwave oven having a silent cooking mode and a method for operating the microwave oven according to an embodiment of the present invention.

Figure 1:
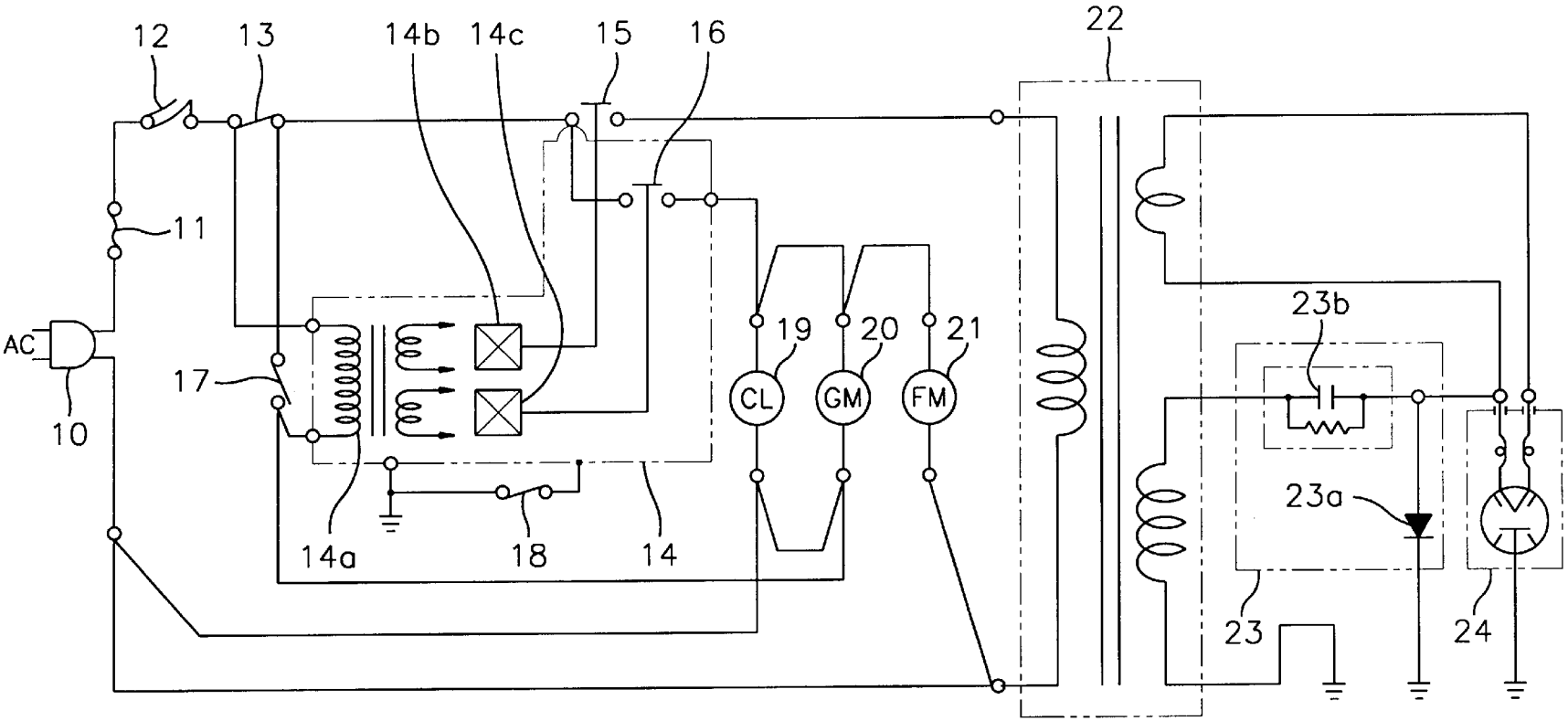
FIG. 1 (PRIOR ART)
FIG. 1 is a block diagram for showing a circuit configuration of an apparatus for controlling a conventional microwave oven.
Figure 2:
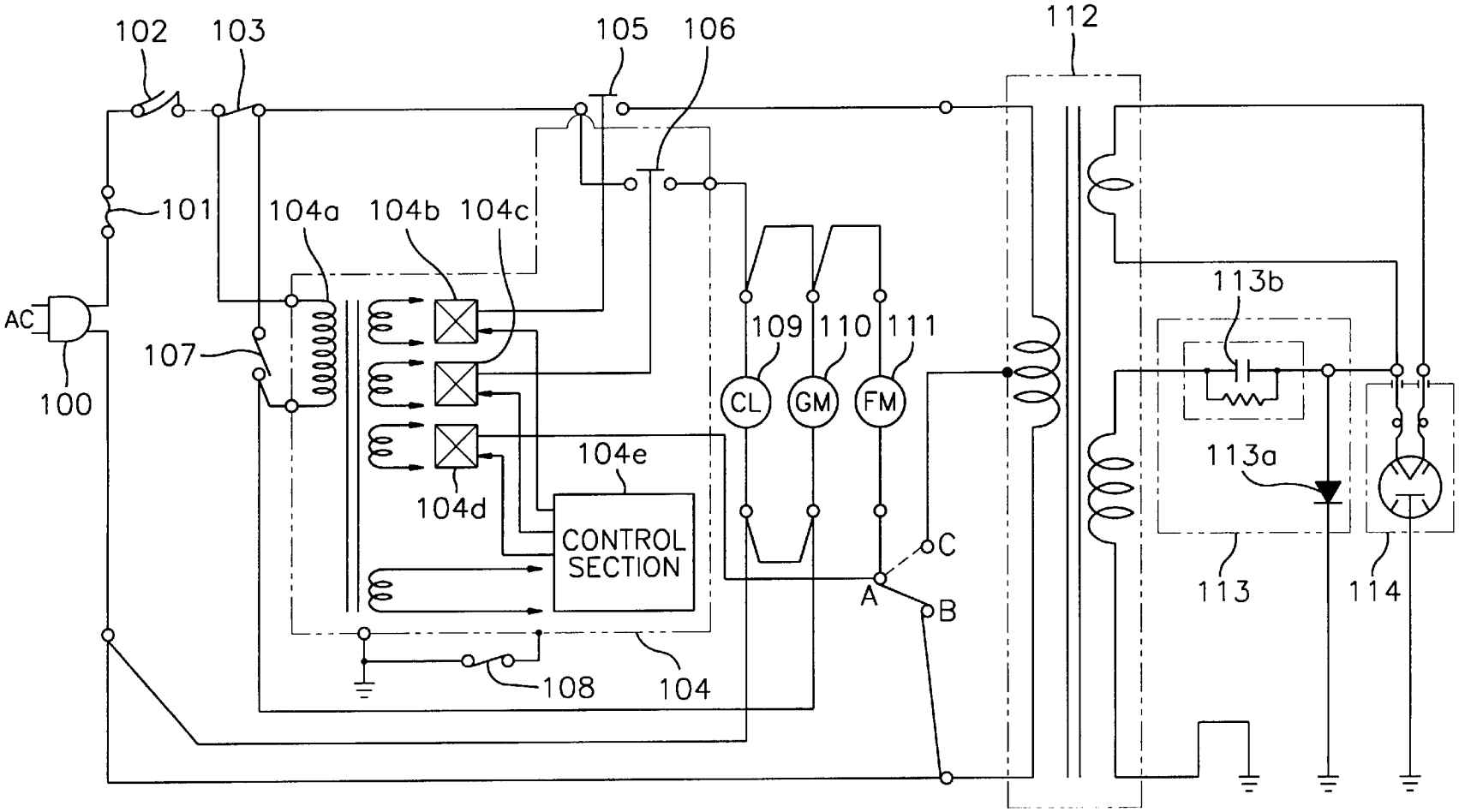
FIG. 2 is a block diagram for showing a circuit configuration of an apparatus for controlling a microwave oven having a silent cooking mode according to an embodiment of the present invention.

FIG. 2 is a block diagram for showing a circuit configuration of apparatus for controlling a microwave oven having a silent cooking mode according to an embodiment of the present invention.

As shown in FIG. 2, the microwave oven having the silent cooking mode has a plug 100, a fuse 101, a temperature switch 102, a first switch 103, a control assembly 104, a high voltage transformer 112, a high voltage rectifying section 113, a magnetron 114, a cooking chamber lamp 109, a tray motor 110, a key operating section (not shown), a fan motor 111, and a second switch 107.

Fuse 101 filters a common alternating current source inputted via plug 100.

Temperature switch 102 is switched according to a temperature generated from a cooking chamber of the microwave oven and either stops or supplies the common alternating current source inputted via fuse 101.

First switch 103 is serially connected to temperature switch 102 and is switched according to the opening and shutting of a door of the microwave oven.

Control assembly 104 drops a voltage level of the common alternating current source applied via temperature switch 102 to a predetermined voltage level by using transformer 104*a*. Control assembly 104 operates in response to the dropped voltage and an external key input signal and controls the common alternating current source which is inputted via first switch 103 and plug 100.

More particularly, control assembly 104 has a low voltage transformer 104*a*, a control section 104*e*, a first relay 104*b*, a second relay 104*c*, and a third relay 104*d*.

Low voltage transformer 104*a* drops the voltage level of the common alternating current source inputted via temperature switch 103 and plug 100 to the predetermined 40 voltage level.

Control section 104*e* converts the voltage from low voltage transformer 104*a* into a constant-voltage of a predetermined level in order to receive the voltage from low voltage transformer 104*a* as an operating voltage and respectively applies control signals to first relay 104*b*, second relay 104*c*, and third relay 104*d* according to key data from 45 the key operating section.

First and second relays 104*b* and 104*c* either short or open contacts 15 and 16 in response to the control of control section 104*e*. First and second relays 104*b* and 104*c* respectively supply the common alternating current source AC which is inputted via first switch 103 to high voltage transformer 112, cooking chamber lamp 109, tray motor 110, and fan motor 111 in response to either shorting or opening contacts 15 and 16.

Third relay 104*d* selectively connects a moving contact A thereof to either a first fixed contact B or to a second fixed contact C in response to a control of control section 104*e* and supplies either the voltage which is divided at the primary winding of high voltage transformer 112 or the common alternating current source which is inputted via the contact of second relay 104*c* to fan motor 111.

Third switch 108 is switched according to either the opening or shutting of the door in order to stop the common alternating current source which is inputted via plug 100.

High voltage transformer 112 divides the voltage of the common alternating current source which is inputted via first switch 103 and plug 100 to a predetermined voltage level at the primary winding thereof in response to the control of control assembly 104 and boosts a voltage level of the divided common alternating current source to a high voltage level at the secondary winding thereof.

High voltage rectifying section 113 has a high voltage diode 113*a* and a high voltage capacitor 113*b* and is connected to the secondary winding of high voltage transformer 112. High voltage rectifying section 113 converts the high voltage inputted from high voltage transformer 112 into a direct current source of high voltage by using high voltage diode 113*a* and high voltage capacitor 113*b*.

Magnetron 114 generates microwaves in response to the high voltage which is inputted from high voltage rectifying section 113 in order to heat the food in the cooking chamber.

Cooking chamber lamp 109 receives the common alternating current source which is inputted via first switch 103 and plug 100 in response to the control of control assembly 104 and emits light to the inside of the cooking chamber in order to visually confirm an inside status of the cooking chamber.

Tray motor 110 is connected to cooking chamber lamp 109 in parallel and rotates a tray, on which the food is put, while the common alternating current source is supplied.

The key operating section (not shown) has a silent cooking key and inputs key data to control assembly 104.

Fan motor 111 operates in response to the common alternating current source which is inputted via first switch 103 by the control of control assembly 104 and the voltage divided in the primary winding of high voltage transformer 112. Fan motor 111 cools heat of magnetron 114, high voltage transformer 112, and the inside of the cooking chamber.

Second switch 107 is connected between a common contact node to which cooking chamber lamp 109 and tray motor 110 are connected and first switch 103 and is switched in the opposite direction of first switch 103 according to the opening and shutting of the door.

In the microwave oven as described above, when the microwave oven is operated at a normal cooking mode, moving contact A of third relay 104*d* is connected to first fixed contact B in order to apply the common alternating current source to fan motor 111. When the microwave oven is operated at a silent cooking mode, moving contact A of third relay 104*d* is connected to second fixed contact C in order to apply a minimum driving voltage VI of fan motor 111 to fan motor 111. At this time, a rated voltage of fan motor 111 is 120 volts and the minimum driving voltage is 80 volts.

A description will be made next of the procedure of the method for operating a microwave oven having a silent cooking mode which is performed by the apparatus shown in FIG. 2, in accordance with the flowchart of FIG. 3.

Figure 3:
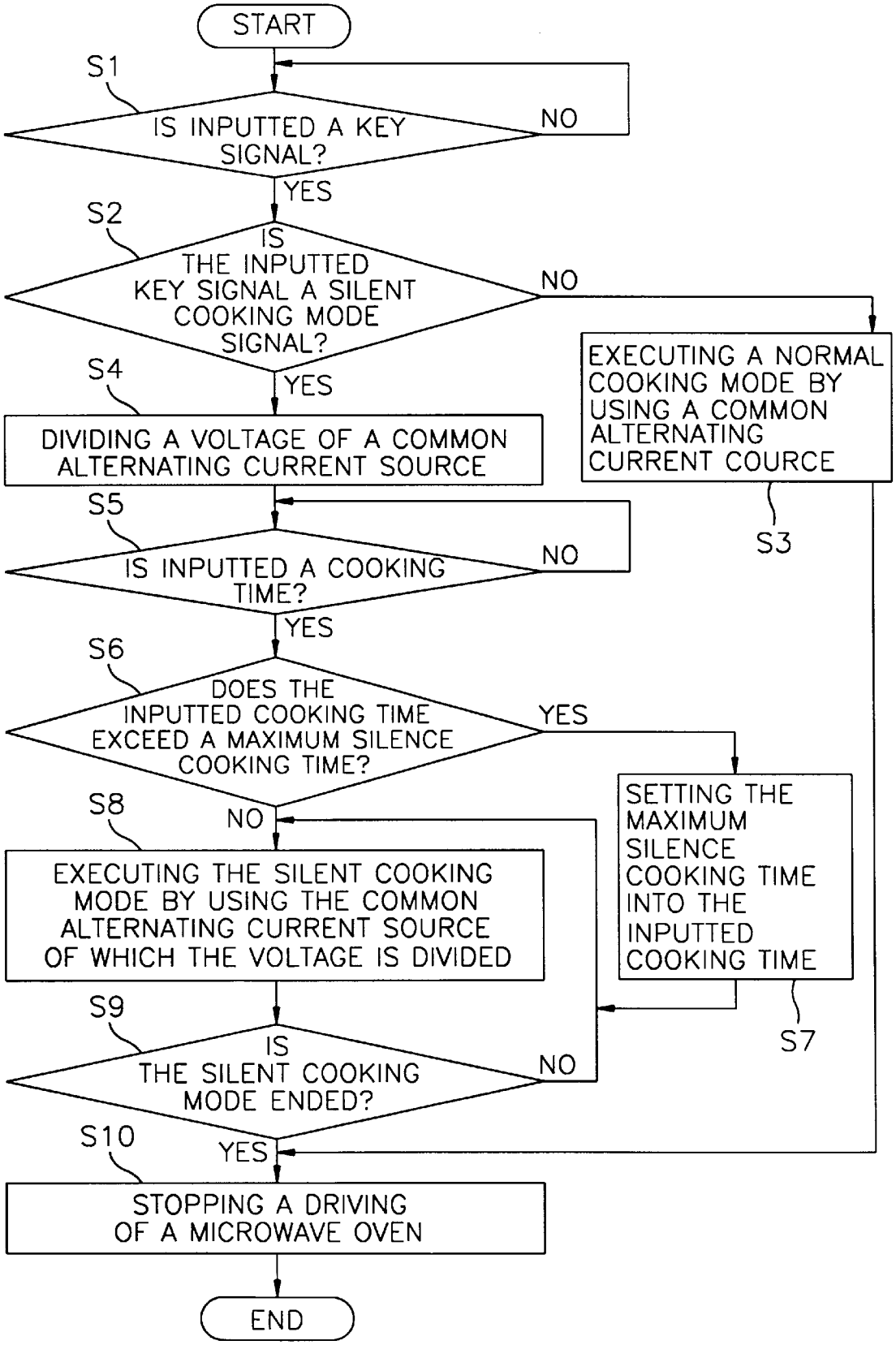
FIG. 3 is a flowchart for illustrating a method for operating the silent cooking mode of the microwave oven by using the apparatus shown in FIG. 2.

FIG. 3 is a flowchart for illustrating a method for operating the silent cooking mode of the microwave oven by using the apparatus shown in FIG. 2.

When the user closes the door of the microwave oven for cooking the food, first switch 103 and third switch 108 are turned on and second switch 107 is turned off.

Accordingly, the common alternating current source from plug 100 is applied to control assembly 104 via fuse 102 and temperature switch 103. The voltage of the common alternating current source which is applied to control assembly 104 is dropped to the predetermined voltage level by low voltage transformer 104*a*. The dropped common alternating current source is respectively applied to first, second, and third relays 104*b*, 104*c*, and 104*d* as an operating voltage and is simultaneously applied to control section 104*e* as an operating voltage.

In the status to which the common alternating current source is being applied, control section 104*e* checks whether or not the key signal is inputted from the key input section (step S1). Control section 104*e* repeatedly executes step S1 when it is checked in step S1 that the key signal is not inputted.

Control section 104*e* checks whether or not a silent cooking mode key signal is inputted when it is checked in step S1 that the key signal is inputted (step S2).

When it is checked in step S2 that the silent cooking mode key signal is not inputted, control section 104*e* turns on first and second relays 104*b* and 104*c* in order to apply the common alternating current source to the primary winding of high voltage transformer 112 and applies the common alternating current source to fan motor 111 in order to execute the normal cooking mode of the microwave oven (step S3).

When it is checked in step S2 that the silent cooking mode key signal is inputted, control section 104*e* connects moving contact A of third relay 104*d* to second fixed contact C in order to divide the voltage of the common alternating current source (step S4).

After then, control section 104*e* checks whether or not a cooking time of the food is inputted from an automatic start key of the key input section by user's operation (step S5).

When it is checked in step S5 that the cooking time is not inputted by the user, control section 104*e* repeatedly executes step S5.

When it is checked in step S5 that the cooking time is inputted by the user, control section 104*e* checks whether or not the inputted cooking time exceeds a maximum silence cooking time of the microwave oven (step S6).

In step S6, when it is checked that the inputted cooking time exceeds the maximum silence cooking time, control section 104*e* sets the maximum cooking time to the cooking time of the microwave oven (step S7).

At this time, the maximum silence cooking time is limited to 5 minutes in order to prevent the cooking chamber from overheating by reducing an amount of wind from fan motor 111 while the silent cooking mode is being executed. Also, the cooking time of the food by the user is variably set by up to 30 seconds.

Accordingly, when the cooking time of the food which is set by a user does not exceed the maximum silence cooking time, control section 104*e* of control assembly 104 excites first and second relays 104*b* and 104*c* by using the common alternating current source of which the voltage is divided in step S4 and executes the silent cooking mode (step S8).

More particularly, when first and second relays 104*b* and 104*c* are excited, the respective contacts 15 and 16 are turned on. Accordingly, the common alternating current source supplied via fuse 101 is applied to the primary winding of high transformer 112 via first switch 103 and first relay 104*b*. Also, the common alternating current source supplied via fuse 101 is respectively applied to cooking chamber lamp 109, tray motor 110, and fan motor 111 via second relay 104*c*.

After then, high transformer 112 divides the voltage of the common alternating current source inputted via first relay 104*b* into a minimum driving voltage of fan motor 110. For example, in the case where the rated voltage of fan motor 110 is 120 volts, high voltage transformer 112 sets the minimum driving voltage into 80 volts.

The high voltage inputted via high voltage transformer 112 is converted into a direct current source by high voltage diode 113*a* and high voltage capacitor 113*b* of high voltage rectifying section 113 and the converted direct current source is applied to magnetron 114.

Magnetron 114 to which the direct current source is applied generates the microwaves for heating the food which is put on the tray of the cooking chamber.

At this time, cooking chamber lamp 109 emits the light to the inside of the cooking chamber in response to the common alternating current source inputted via second relay 104*c* and plug 100. Tray motor 110 rotates the tray on which the food is put in response to the common alternating current source which is inputted via second relay 104*c* and plug 100. Accordingly, the food which is put on the tray is uniformly cooked.

Also, fan motor 111 inhales external air and cools the heat generated from high voltage transformer 112 and magnetron 114 by using the inhaled external air.

Control section 104*e* checks whether or not the cooking time of the food is reached the set cooking time (step S9).

When it is checked in step S9 that the cooking time of the food reaches the set cooking time, control section 104*e* turns off first and second relays 104*b* and 104*c* of control assembly 104 in order to stop the driving of high voltage transformer 112, cooking chamber lamp 109, fan motor 111, and tray motor 110. Also, control section 104*e* switches moving contact A of third relay 104*d* to fixed contact B in order to turn off third relay 104*d* and stops the driving of the microwave oven (step S10).

In the microwave oven having a cooking mode and method for operating thereof according to the present invention, a rotation speed of the fan motor of the microwave oven is variably set according to the selection of a user. Accordingly, when the user selects the silent cooking mode, a noise generated from the fan motor is reduced remarkably. As a result, the user can comfortably cook the food at night.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A microwave oven having a silent cooking mode, wherein said microwave oven has a magnetron driving means connected to a secondary winding of a high voltage transformer which receives an external power source via a primary winding thereof, said apparatus comprising:

a fan motor for ventilating a cooking chamber of said microwave oven;

a silent cooking mode selecting key for selecting the silent cooking mode;

voltage dividing means for dividing a voltage of the external power source;

switching means for supplying the external power source to said fan motor at a normal cooking mode and for supplying the external power source of which the voltage is divided by said voltage dividing means to said fan motor at the silent cooking mode; and control means for controlling said switching means in response to a key signal from said silent cooking mode selecting key.

2. The microwave oven having a silent cooking mode as claimed in claim 1, wherein said voltage dividing means is the high voltage transformer having a center tap, wherein said high voltage transformer divides the voltage of the external power source applied to the primary winding thereof and outputs the external power source of which the voltage is divided.

3. The microwave oven having a silent cooking mode as claimed in claim 1, wherein the external power source of which the voltage is divided by said voltage dividing means is a minimum driving voltage for driving said fan motor.

4. The microwave oven having a silent cooking mode as claimed in claim 3, wherein a rated voltage of said fan motor is 120 volts and the minimum driving voltage is 80 volts, respectively.

5. The microwave oven having a silent cooking mode as claimed in claim 1, wherein a maximum driving time of said switching means is 5 minutes and is variably set by up to 30 seconds by means of a user.

6. A method for operating a microwave oven having a silent cooking mode, said method comprising the steps of:

(i) checking whether or not a silent cooking mode is selected;

(ii) executing a normal cooking mode by supplying an external power source to a fan motor when it is checked in step (i) that the silent cooking mode is not selected; and (iii) executing the silent cooking mode by supplying the external power source of which the voltage is divided to said fan motor when it is checked in step (i) that the silent cooking mode is selected.

7. The method for operating a microwave oven having a silent cooking mode as claimed in claim 6, wherein said step (iii) comprises the substeps of:

(iii-1) checking whether or not a cooking time is set;

(iii-2) returning to step (iii-1) when it is checked in step (iii-1) that the cooking time is not set; and (iii-3) executing the silent cooking mode by supplying the external power source of which the voltage is divided to said fan motor during the set cooking time when it is checked in step (iii-1) that the cooking time is set.

8. The method for operating a microwave oven having a silent cooking mode as claimed in claim 7, wherein the cooking time is 5 minutes and is variably set by up to 30 seconds by means of a user.

9. The method for operating a microwave oven having a silent cooking mode as claimed in claim 7, further comprising the substeps of:

(a) checking whether or not the set cooking time exceeds a maximum silence cooking time;

(b) executing the silent cooking mode when it is checked in step (a) that the set cooking time does not exceed the maximum silence cooking time; and (c) setting the maximum silence cooking time to the set cooking time when it is checked in step (a) that the set cooking time exceeds the maximum silence cooking time.

10. A method for operating a microwave oven having a silent cooking mode, said method comprising the steps of:

(A) checking whether or not a silent cooking mode is selected;

(B) executing a normal cooking mode by supplying an external power source to a fan motor when it is checked in step (A) that the silent cooking mode is not selected;

(C) checking whether or not a cooking time is set when it is checked in step (A) that the silent cooking mode is selected;

(D) returning to step (C) when it is checked in step (C) that the cooking time is not set;

(E) checking whether or not the set cooking time exceeds a maximum silence cooking time when it is checked in step (C) that the cooking time is set;

(F) executing the silent cooking mode when it is checked in step (E) that the set cooking time does not exceed the maximum silence cooking time; and (G) setting the maximum silence cooking time to the set cooking time when it is checked in step (E) that the set cooking time exceeds the maximum silence cooking time.

* * * * *